US006464597B1

(12) United States Patent
Hardesty

(10) Patent No.: US 6,464,597 B1
(45) Date of Patent: Oct. 15, 2002

(54) REFERENCE POINT GOLF SWING TRAINER

(76) Inventor: George Ramond Hardesty, 6179 Chambore Dr. North, Jacksonville, FL (US) 32256

( * ) Notice: Subject to any disclaimer, the term of this patent is extended or adjusted under 35 U.S.C. 154(b) by 0 days.

(21) Appl. No.: 09/571,995

(22) Filed: May 16, 2000

(51) Int. Cl.[7] ..... A63B 69/36
(52) U.S. Cl. ..... 473/268
(58) Field of Search ..... 473/219, 257, 473/266, 268, 256

(56) References Cited

U.S. PATENT DOCUMENTS 1,091,186 A * 3/1914 Brown ..... 473/268 X
4,326,718 A * 4/1982 Kiehl ..... 473/219 X
5,188,367 A * 2/1993 Gipe et al. ..... 473/229
5,334,028 A * 8/1994 Melligan ..... 473/266 X
5,460,378 A * 10/1995 Getts ..... 473/256 X
5,634,858 A * 6/1997 Bellagamba ..... 473/257
5,672,118 A * 9/1997 Robbie ..... 473/257
5,707,300 A * 1/1998 May et al. ..... 473/257

FOREIGN PATENT DOCUMENTS

WO 94/28983 * 12/1994 ..... 273/188 R

* cited by examiner

*Primary Examiner*—Raleigh W. Chiu

(57) ABSTRACT

The Reference Point Golf Swing Trainer is a device that provides a reference point that may used to assist golfers in monitoring different aspects of the golf swing. Use of this device will allow the golfer to train the muscles used in the golf swing to perform the proper repetitions of the swing without any conscious effort. The device does not encumber the user, it is portable, economical and adjust to many configurations. It may be used anywhere there is room to safely swing a golf club without assistance from a second party. The only limits to its use in assisting the golfer to focus on the finer points of the golf swing is the users imagination.

11 Claims, 6 Drawing Sheets

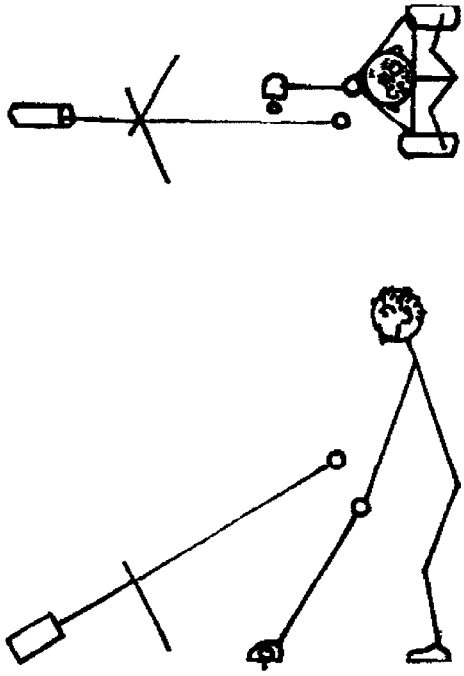
FIG, 3
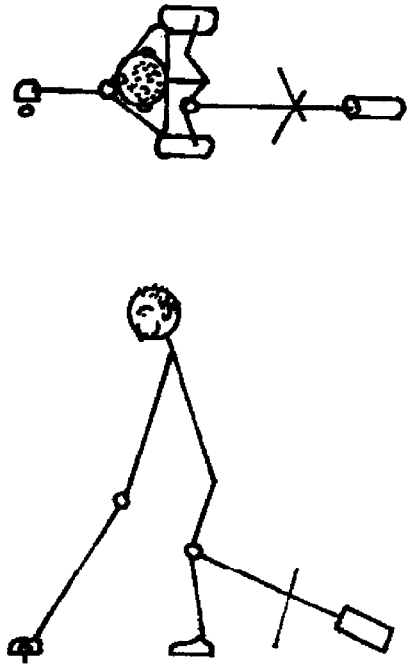
FIG. 4
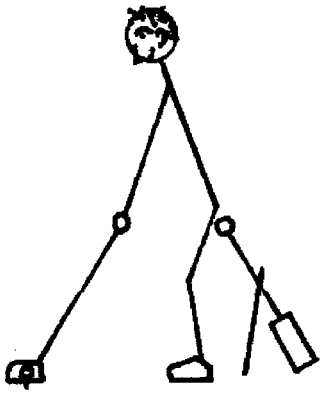
FIG. 5
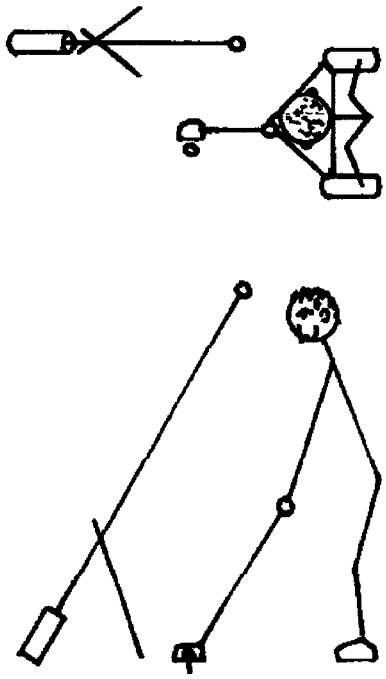
FIG. 6

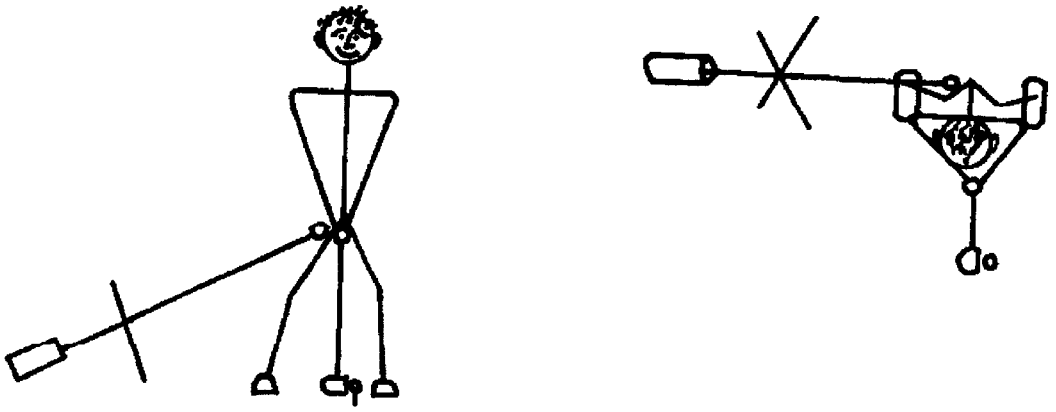
FIG. 7
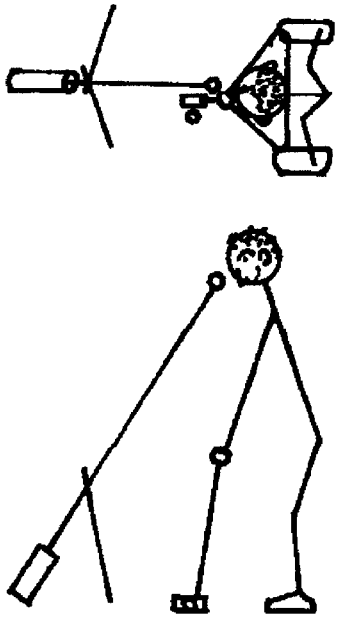
FIG.8
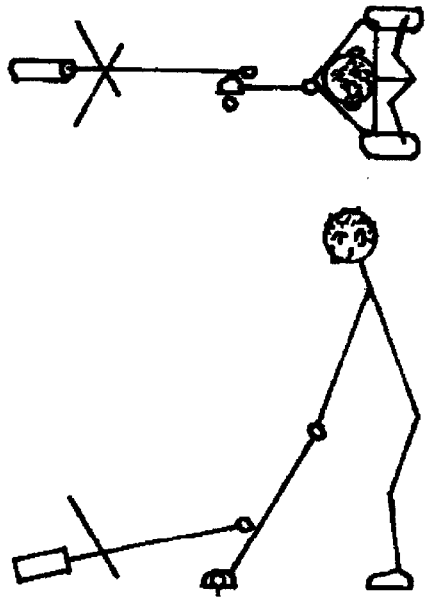
FIG.9
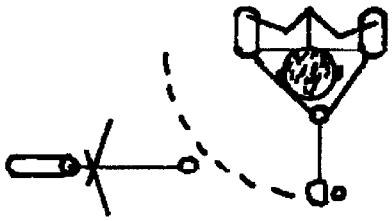
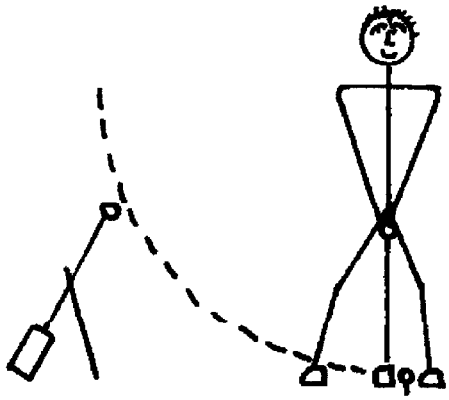
FIG.10

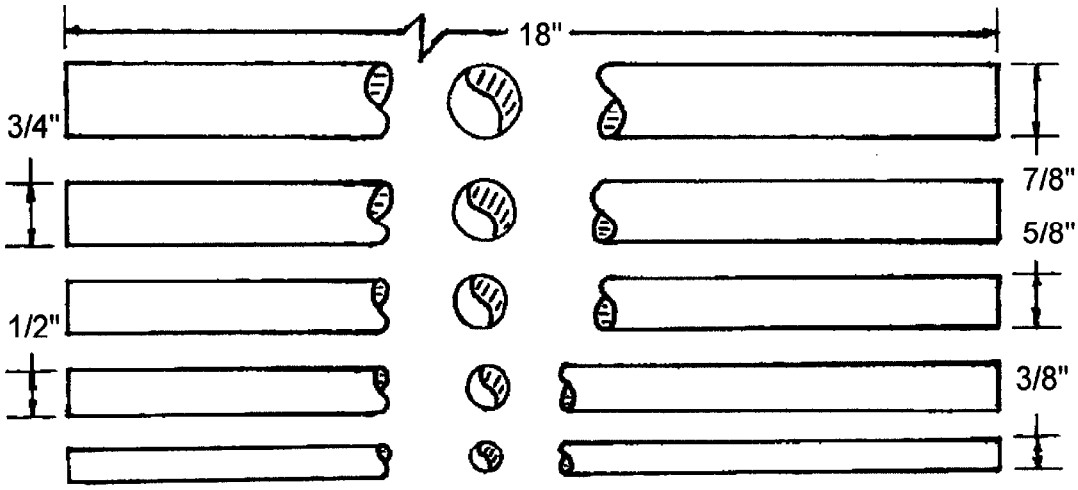
FIG. 11
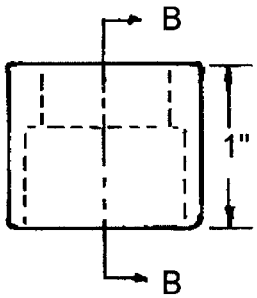
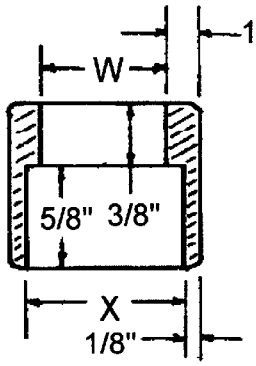
SECTION B-B
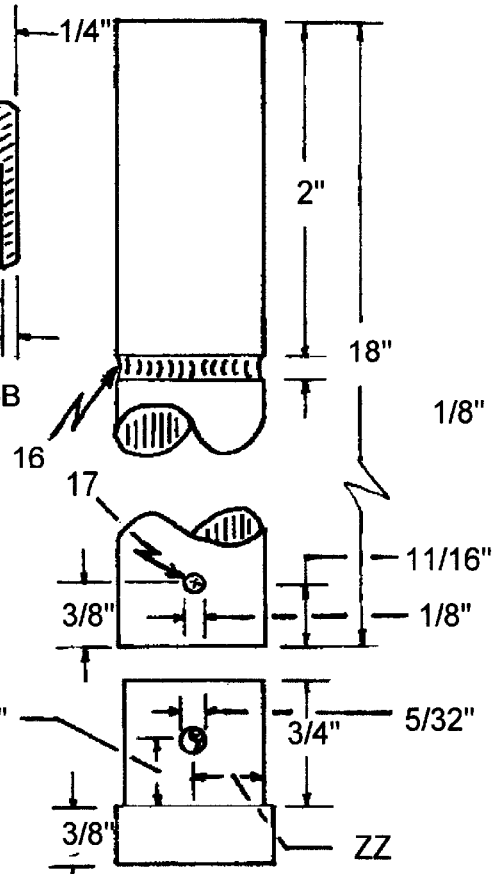
TYP. FIG. 14
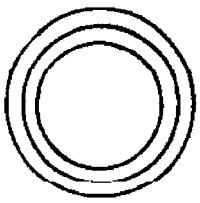
FIG. 12
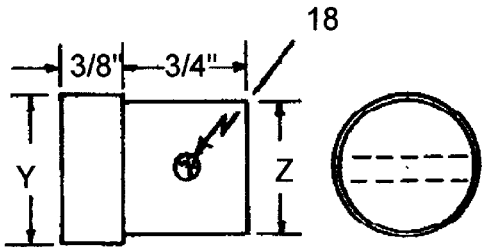
FIG. 13

REFERENCE POINT GOLF SWING TRAINER

CROSS-REFERENCES TO RELATED APPLICATIONS

| U.S. Patent Documents | | |
|---|---|---|
| 4446480 | May., 1984 | Breglia et al. |
| 4502035 | Feb., 1985 | Obenauf et al. |
| 4605226 | Aug., 1986 | Morrissey. |
| 4869509 | Sep., 1989 | Lee. |
| 5108104 | Apr., 1992 | Johnson. |
| 5524894 | Jun., 1996 | Shannon. |
| 5538250 | Jul., 1996 | Putz. |

STATEMENT REGARDING FEDERALLY SPONSORED RESEARCH OR DEVELOPMENT

Not applicable

REFERENCE TO THE INVENTION

Not applicable

REFERENCE TO A MICROFICHE APPENDIX

Not applicable

The Reference Point Golf Swing Trainer is an economical, portable, easy to use device that provides the user with a reference point to train the muscles used in the golf swing.

BACKGROUND OF THE INVENTION

It is a well established fact that a consistent and repeatable golf swing is the result of physical ability, proper training, and practice. Volumes have been written about the subject and thousands of golf professionals teach the elements of the golf swing every day.

There are many devices sold to train the golfer in the art of swinging the golf club. These devices range in complexity from a broken golf club shaft that can be stuck in the ground as a reference point to an expensive system of cables, straps, poles and brackets that are intended to control the actions of the user through a range of motion. In the visual spectrum, training aids range from a full length mirror to professional video systems that allow the golfer to compare their swing to an electronic model. There are also audible devices to detect head movement and swing path.

Professional golf instructors employ many techniques in their efforts to teach the golf swing;

Keep Your Head Steady, Senior Golf, March 1996, page 45; Brad Brewer holds the grip end of a club against the forehead of his students to help them monitor head movement during the golf swing.

Tips From The Tour, Golf Digest, January 1998, page 66; Catrona Maththews holds the bill of the students baseball cap to stabilize the students head during the golf swing.

Instant Lesson, Golf Digest, February 1997, page 51; Murry St. Onge suggests using a ski pole stuck in the ground to provide a reference to monitor head movement during the swing.

Wrong Turn, Golf Digest/Total Golf, page 131; Mark Steinbauer uses two club shafts stuck in the ground to check hip slide during the swing.

The Key To Distance: Swing Down In Sequence, Golf Digest/Total Golf, page 7; Scott Davenport uses a club shaft to observe hip slide and rotation during the swing.

Make A Powerful Pivot, Golf Digest/Total Golf, page 63; Hank Johnson uses the edge of a table to teach hip stabilization during the back swing.

One Move For Power, Golf Digest/Total Golf, pages 106 and 107; Chuck Cook uses a range ball basket or a bunker rake between the knees to monitor knee movement during the swing.

So You Want Perfection?, Golf Magazine. July 1994, page 73; Hank Johnson sticks a club shaft in the ground to teach his students the proper take away on the back swing.

The Right Way To Use Your Arms, Golf Digest/Total Golf, page 49; Mitchell Spearman uses a golf bag as a reference point to teach the back swing.

Space Out Your Swing, Golf Digest/Total Golf, page 75; Tim Mahoney sits on a bag rack to monitor the flex in his knees during the golf swing.

Catalog Of Drills, Golf Tips, March 1998, Page 113; David Leadbetter sits on the back of a lawn chair to monitor the flex in his knees during the golf swing.

Is your Swing Plane Too Steep? Golf Digest/Total Golf, page 43; Tim Mahoney use a golf bag with a built-in stand as a reference for the proper golf swing plane.

How To Swing From In To Square, Golf Digest/Total Golf, page 49; Mitchell Spearman uses a club laid across the top of a golf bag as a focus point to practice the path his hands must follow to create the desired swing.

Some professional golfers endorse devices that are advertised to teach the perfect swing and lower your score;

David Leadbetter demonstrates and promotes "The Coach," which is a platform with a spring pole and cable that attaches to a stick like device which the golfer swings to "develop consistent action".

Jack Nicklaus endorses the "Sound Advice," an electronic device that slips over the golf club grip. It beeps to analyze and pin point swing faults.

Peter Kostis promotes the "Swing Shaper," which is a set of rails that is designed to give the user a feel for the golf swing by forcing the user to swing between the rails.

Gary Player sells "The Gary Player Swing Trainer," a device that straps to the right handed golfer's left arm and "gets you in the hit zone."

John Daly endorses "The Power Grove," a large base and pole with a cord that attaches to the golf club shaft, forcing the user to swing in a fixed path.

There are several video systems available. Most golfers cannot afford to buy one because they are very expensive. They are usually found at teaching centers, operated by professional instructors.

All of the above devices, techniques and systems are intended to teach the golfer to swing the club in a manner that will produce a repeatable swing that produces solid contact between the club head and the ball, resulting in consistent distance and direction of the golf ball. No doubt each of these devices have benefits if used frequently in the manner prescribed.

The disadvantages are as varied as there are devices. Some are very expensive and difficult to assemble, others are not portable enough for convenient use and most are restrictive and cumbersome when used. The most objectionable feature of many is that they do not take into consideration that everyone has different abilities and physical limits. They train the swing by forcing the user to perform the complete swing or a portion thereof in a restricted manner.

Even the casual observer can see that professional golfers have individual quirks in the their swing. This is why good teaching professionals do not make immediate drastic changes in a students natural swing, but make slight adjustments to maximize their natural abilities. As a result, the teaching professional, will use golf shafts, tables, chairs, golf bags, ski poles, holding cap bills, the butt of a club to the forehead and other readily available items to give the student a focus point to practice the golf swing.

BRIEF SUMMARY OF THE INVENTION

The Reference Point Golf Swing Trainer (RPGST), consists of one adjustable leg, two fixed length legs, connected together by an elastic "O" ring, a counter weight on the base end of the adjustable leg, and a focus point on the other. When extended, the adjustable leg is eighty four inches long. It is twenty five inches long when collapsed and fits in a carrying pouch for ease of portability and storage. It is very affordable, easy to assemble and easy to use.

The purpose of the invention is to give the golfer a reference point at strategic points when practicing the golf swing. The invention will allow a golfer to train the muscles used in various elements of the golf swing to consistently repeat the desired movements without conscious effort or assistance. It may be used anywhere there is room to safely swing a golf club indoors or outdoors.

The RPGST may be used to monitor head movement, hip slide, knee movement, knee flex, takeaway on the back swing, head movement while putting, to grove an inside to out swing path and establish a swing gate for the hands. It may also be setup to monitor other elements of the swing that will benefit from the golfers attention.

BRIEF DESCRIPTION OF THE SEVERAL VIEWS OF THE DRAWING

Drawing 1/6.

Drawing 2/6;

FIG. 3 illustrates the invention in position to allow the golfer to practice the golf swing while monitoring the swing path of the hands.

Drawing 2/6 continued.;

FIG. 4 shows the invention in position to allow the golfer to observe the movement of the left knee during the golf swing.

FIG. 5 demonstrates the invention in position to allow the golfer to monitor the amount of knee flex during the golf swing.

FIG, 6 shows the invention setup to indicate the plane of the golf swing.

Drawing 3/6,

FIG. 7 illustrates the invention positioned to permit the golfer to monitor the slide of the hips to the right during the back swing.

FIG. 8 shows the invention set up to provide a reference point for the golfer to maintain a steady head position during the putting stroke.

FIG. 9 demonstrates the invention positioned to allow the golfer to practice an inside to out swing path.

FIG. 10 illustrates the invention set up to provide a reference point for an on line take away on the back swing.

Drawing 4/6;

FIG. 11 shows the five aluminum tubes that make up the adjustable leg.

FIG. 12 illustrates the connectors that join the tubes in FIG. 11 together.

FIG. 13 illustrates the tube stop plug. One of each size to fit the four smallest tubes in FIG. 11, is installed in one end of each tube.

FIG. 14 shows a typical tube with the stop plug, stop plug crimp and stop crimp.

Figure 15:
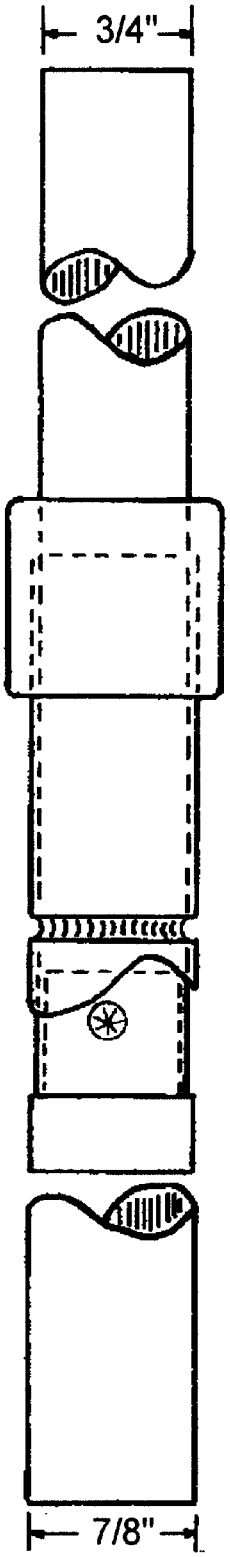
Figure 16:
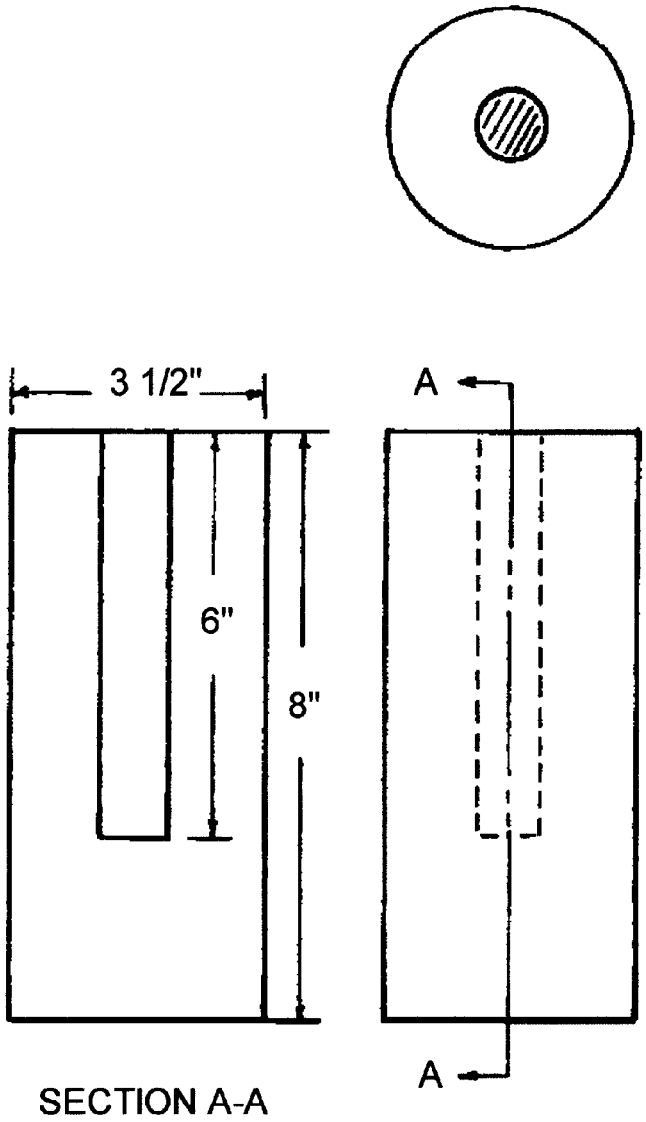

Drawing 5/6;

FIG. 15 illustrates a typical tube assembly with the seven eights inch tube nested with the three quarter inch, a typical connector, the stop plug and the stop crimp FIG. 16 shows the cast counter weight.

Figure 17:
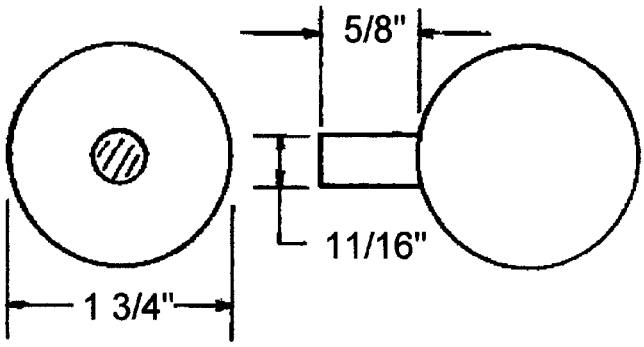

FIG. 17 shows the reference point ball.

Figure 18:
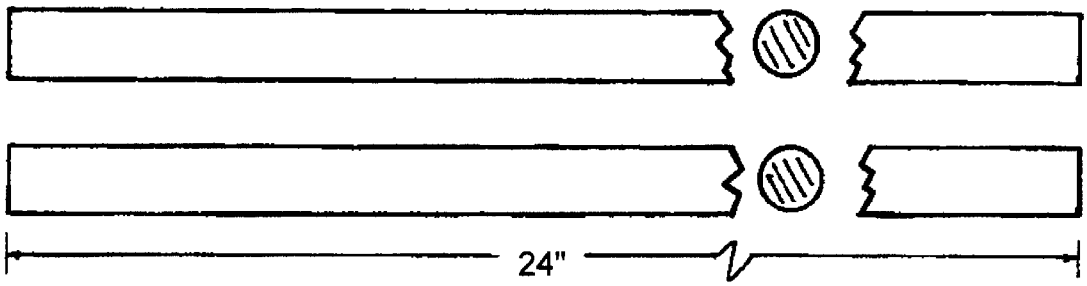

FIG. 18 illustrates the two fixed length legs.

Drawing 6/6 continued.

Figure 19:
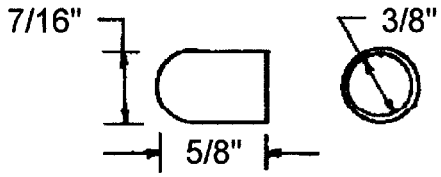

FIG. 19 shows the plastic end caps for FIG. 18.

Figure 20:
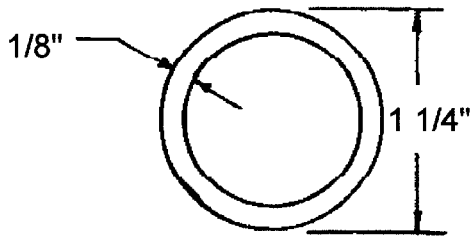

Drawing 2/6 continued;

FIG. 20 is the "O" ring that connects the fixed length legs to the adjustable leg.

Figure 1:
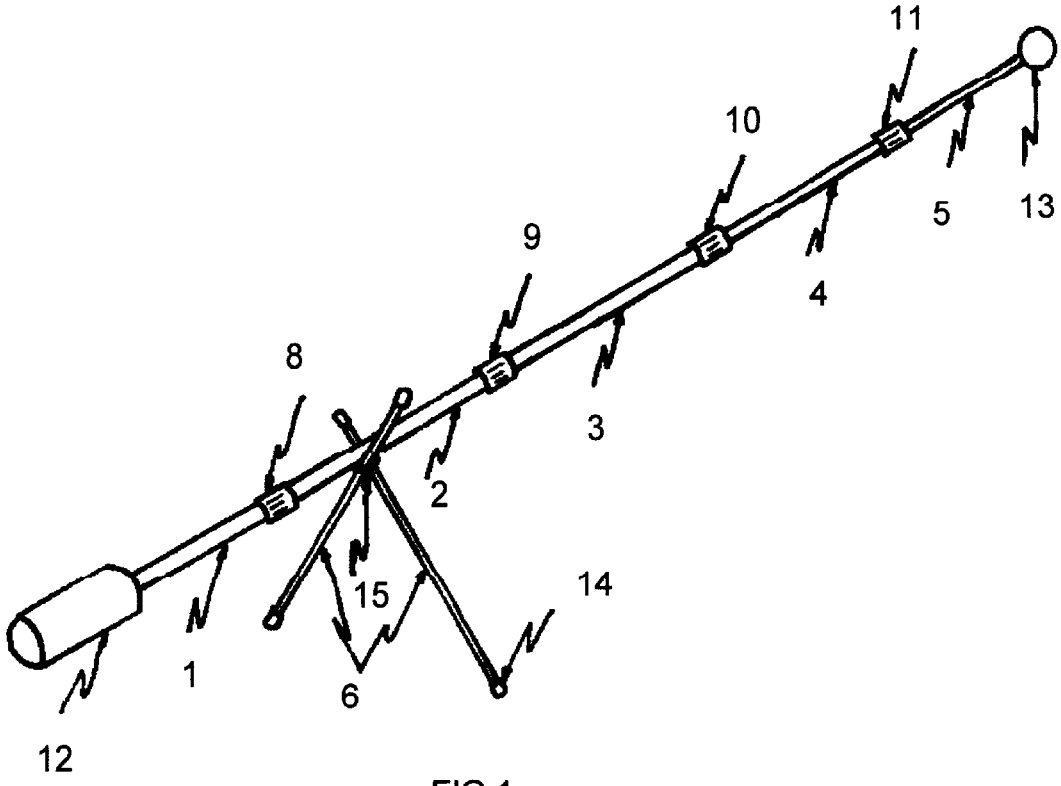
FIG. 1 consists of one adjustable leg, made up of elements, 1, through 5 and 7 through 11, two fixed length legs, element 6, which are connected together by an elastic "O" ring, element 15, a counter weight, element 12, and a focus point, element 13.

DETAILED DESCRIPTION OF THE INVENTION;

Drawing 1/6;

FIG. 1, elements of the adjustable leg 1, 2, 3, 4 and 5 are aluminum tubes with a wall thickness of three sixty-fourths inch and outside dimensions as shown in Drawing 4/6; FIG. 11. The adjustable leg is seventy-eight inches long when fully extended and twenty five inches long when fully collapsed.

FIG. 1, fixed length legs, element 6, are aluminum rods, fitted with rod end caps, illustrated in Drawing 6/6, FIG. 19. The caps are plastic and four are required.

FIG. 1, Connectors, elements 8, 9, 10 and 11, are extruded plastic, as illustrated in Drawing 4/6, FIG., element 12. They designed to provide an interference fit for the fixed tube and a slip fit for the nesting tube.

FIG. 1, counter weight, element 12, illustrated in Drawing 5/6, FIG., element 16, is cast Portland cement and glued to the base end of the adjustable leg.

FIG. 1, focus point ball, element 13, illustrated in Drawing 5/6, FIG. 17, is extruded plastic, painted day glow orange and glued to the adjustable leg.

FIG. 1,"O" ring, element 14, illustrated in Drawing 6/6, FIG. 20, is neoprene rubber and is used in conjunction with the fixed length legs to form a cradle for the adjustable leg.

FIG. 1 illustrates the invention set up in the fully extended position. When collapsed, it fits in a twenty six by four inch pouch for portability and storage.

Figure 2:
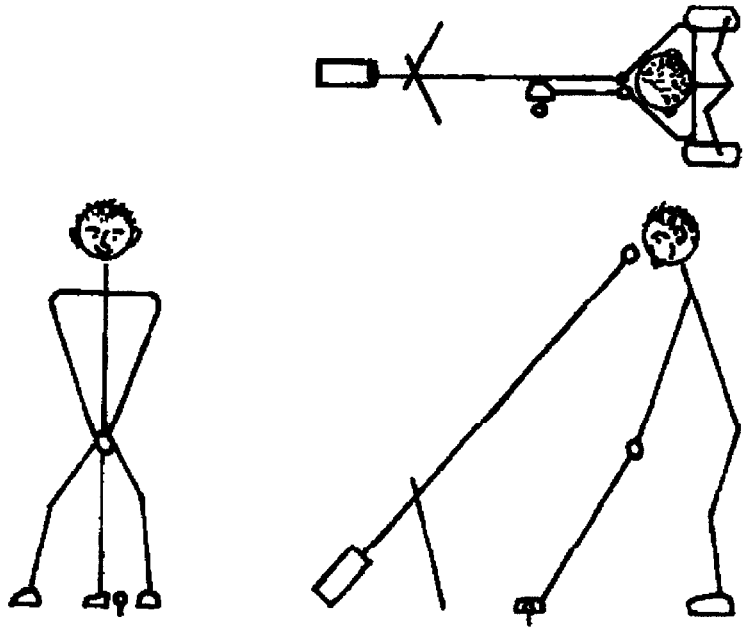
FIG. 2 shows the invention in position to allow the golfer to practice the golf swing while maintaining a steady head position.

FIG. 2, Drawing 2/6, FIGS. 3, 4, 5 and 6 and Drawing 3/6, FIGS. 7, 8, 9 and 10 illustrate some of the strategic points that will benefit from the use of this invention.

The purpose of the invention is to give the golfer a reference point when practicing the golf swing. It may be used anywhere it is safe to swing a golf club and there is never a need for assistance from a second party. The invention will allow a golfer to train the muscles used in various elements of the golf swing to consistently repeat the desired movements of the swing without a conscious effort.

Note: AR illustrations and references are intended for right handed golfers.

FIG. 2 illustrates the position of the invention with the adjustable leg fully extended and perpendicular to the swing path, with the Reference Point four to six inches in front of the golfers eyes. With the Reference Point in the golfers peripheral vision, the user will be able to monitor head movement during the golf swing.

Drawing 2/6

FIG. 3 illustrates the position of the invention that will allow golfer to maintain the hands in a desired area close to the body during the swing. With the invention configured and set up with the adjustable leg fully extended and perpendicular to the swing path and the Reference Point six inches above and two inches in front of the hands in the address position, a guide or gate is created for the golfers hands to swing through during the golf swing. In order to produce a powerful and flat swing path, the hands must pass close to the body on the down swing. This will allow the user to grove the swing by repeatedly swinging through the gate.

FIG. 4 illustrates the position of the invention that will allow golfer to monitor the movement of the left knee during the swing. When configured and set up behind the golfer with the adjustable leg thirty percent extended and perpendicular to the swing path with the Reference Point three inches inside the golfers left knee. The golfer will be able to judge the movement of the knee during the swing. The knee should move slightly to the right on the back swing and move toward the target at the start of the down swing. Proper movement of the left knee is a key factor in balance and power during the swing.

FIG. 5 shows the invention configured and set up behind the golfer with the adjustable leg extended as required and perpendicular to the swing path with the Reference Point in contact with the golfers buttocks. This will allow the golfer to monitor the amount of flex in the knees, while in the address position, during the golf swing. A slight flex in the knees is considered to be an athletic position which is necessary for the lower body and legs to provide power to the swing and maintain good balance.

FIG. 6 illustrates the invention configured and set up, fully extended, on a forty five degree angle, perpendicular to the swing path, two feet in front of and two feet to the right of the golfer, to establish a guide for the proper swing plane. This will allow the golfer to monitor the proper angle of the club shaft during the golf swing. The desired angle in relationship to the ground is forty five degrees.

Drawing 3/6;

FIG. 7 illustrates the invention configured and set up with the adjustable leg fifty per cent extended, parallel to the swing path, to the right of the golfer, with the Reference Point touching the golfers right hip. This will allow the golfer to monitor the slide of the hips during the golf swing. Hip slide to the right causes loss of power, contact with the ground prior to striking the ball and loss of balance.

FIG. 8 illustrates the invention configured and set up with the adjustable leg, in front of and perpendicular to the swing path, with the Reference Point four inches in front of and two inches below the golfers eyes to allow the golfer to monitor head movement during the putting stroke. A fixed head and body position is essential in the putting stroke. Any movement of the head or body will effect distance and direction of the ball.

FIG. 9 illustrates the invention configured and set up with the adjustable leg twenty per cent extended, perpendicular to the swing path, with the Reference Point six inches above, four inches to the right and four inches inside the teed up golf ball. This setup will allow the golfer to develop an inside swing path. The inside swing path is desirable because it creates the desirable flat arch at the bottom of the swing and allows the club face to contact the ball in a squared relationship to the target line. It also increases distance and controls direction of the flight of the ball.

FIG. 10 demonstrates the invention configured and set up to the golfer's right, with the adjustable leg thirty percent extended, parallel to the swing path with the Reference Point four or five feet from the right foot and two feet above the ground, in line with the swing path. This will provide a reference point that will allow the golfer to train to take the club straight back along the swing path at the start of the back swing. This starts the club out along the swing plane that is being trained for in FIG. 6.

Drawing 4/6;

FIG. 14, illustrates a typical tube as shown in FIG. 11 being made ready for assembly. Tube stop element, Drawing 4/6, FIG. 13, is inserted in the end of the four smaller tubes and crimped in place, element 17. Dimension 'Y' in Drawing 4/6, FIG. 13, is one thirty-second inch larger than "Z." The "Z" dimensions corresponds to the inside diameter of four smaller tubes, Drawing 4/6, FIG. 11. The four larger tubes are crimped to provide a stop for the tube stop, Drawing 4/6, element 16.

The tubes in FIG. 11 are assembled as shown in Drawing 5/6, FIG. 15. The four larger tubes are joined using the plastic extruded connectors, as illustrated in Drawing 4/6, FIG., 12. The larger diameter tube is glued into the connector and the smaller tube is inserted to allow for a slip fit. Dimensions expressed in the illustration as "W" and "X" are intended to correspond with the tubing diameters in Drawing 4/6, FIG. 11.

The counter weight, Drawing 1/6, FIG. 1, 12, is glued to the end of the seven eighths inch tube, Drawing 5/6, FIG. 11.

Reference point, Drawing 1/6, FIG. 13 is glued to the end of the three eighths inch tube, Drawing 5/6, FIG. 17.

The final assembly of the invention; Fit the "O" ring, Drawing 6/6, FIG. 20, over the two fixed length legs, Drawing 1/6, FIG. 1, element 6, being held parallel to each other to about three inches from one end. Place the expandable leg, Drawing 1/6, FIG. 1, element 1 between the fixed legs at the "O" ring. Spread the fixed length legs to form a cradle to support the adjustable leg.

What is claimed is:

1. The Reference Point Golf Swing Trainer (RPGST), which is comprised of an adjustable leg, a counter weight at one end of the adjustable leg, a high visibility ball on the opposite end, two fixed length legs joined with an "O"ring to form a flexible joint that allows the RPGST be set up for several different configurations related to specific points to be monitored and practiced during the golf swing.

2. The RPGST in claim 1 whereby said trainer is configured and set up with the adjustable leg fully extended and perpendicular to the swing path with the Reference Point four to six inches in front of the golfers eyes, allowing the golfer to monitor head movement during the golf swing.

3. The RPGST in claim 1 whereby said trainer is configured and set up with the adjustable leg fully extended and perpendicular to the swing path with the Reference Point six inches above and two inches in front of the hands in the address position, creating a guide or gate for the golfers hands to swing through during the golf swing.

4. The RPGST in claim 1 whereby said trainer is configured and set up behind the golfer with the adjustable leg thirty percent extended and perpendicular to the swing path with the Reference Point three inches inside the golfers left knee, which will allow the golfer to monitor the movement of the knee during the golf swing.

5. The RPGST in claim 1 whereby said trainer is configured and set up behind the golfer with the adjustable leg extended as required and perpendicular to the swing path with the Reference Point in contact with the golfers buttocks when in the address position, allowing the golfer to train to maintain the proper knee flex, and posture during the golf swing.

6. The RPGST in claim 1 whereby said trainer is configured and set up, fully extended, on a forty-five degree angle, perpendicular to the swing path, two feet in front of and two feet to the right of the golfer, to establish a guide for the proper swing plane.

7. The RPGST in claim 1 Whereby said trainer is configured and set up with the adjustable leg fifty per cent extended, parallel to the swing path, to the right of the golfer (right hand golfer), with the Reference Point touching he golfers eight hip, allowing the user to monitor the slide of the hips during the golf swing.

8. The RPGST in claim 1 whereby said trainer is set up with the adjustable leg perpendicular to the swing path with the Reference Point four inches in front of and two inches below the golfers eyes allowing the golfer to monitor head movement during the puffing stroke.

9. The RPGST in claim 1 my be configured and set up with the adjustable leg twenty per cent extended, perpendicular to the swing path with the Reference Point six inches above, four inches to the right (right hand golfer) and four inches inside the teed up golf ball willing allow the golfer to train to approach the ball on a inside to out swing path on the down swing.

10. The RPGST in claim 1 whereby said trainer is configured and set up to the golfer's right (right hand golfer), with the adjustable leg thirty Percent extended, parallel to the swing path with the Reference Point four or five feet from the right foot and two feet above the ground, in line with the swing path allowing the user to move the club straight back on the back swing.

11. The RPGST in claim 1 is portable and it fits into a twenty six long by four inch wide carrying and storage pouch, thereby allowing the golfer to use the trainer on the golf course during practice rounds.

* * * * *